169-47 SR

2/3/81 OR 4,248,309

United States Patent [19]

Hofle et al.

[11] 4,248,309

[45] Feb. 3, 1981

[54] FIRE EXTINGUISHING SYSTEM UTILIZING THE ENGINE COOLING SYSTEM

[75] Inventors: Anatoli Hofle, Waynesville; Doyle V. Haren, Clyde, both of N.C.

[73] Assignee: Dayco Corporation, Dayton, Ohio

[21] Appl. No.: 56,566

[22] Filed: Jul. 11, 1979

[51] Int. Cl.[3] ..... A62C 35/12

[52] U.S. Cl. ..... 169/47; 169/9; 169/14; 169/40; 169/62

[58] Field of Search ..... 169/5, 9, 14, 15, 16, 169/37, 38, 39, 40, 41, 42, 43, 46, 47, 57, 59, 62, 90; 123/198 D

[56] References Cited

U.S. PATENT DOCUMENTS

| | | | |
|---|---|---|---|
| 1,137,016 | 4/1915 | Nutter | 169/40 |
| 1,877,649 | 9/1932 | Dugas | 169/47 |
| 2,389,334 | 11/1945 | Tyden | 169/40 |
| 3,010,521 | 11/1961 | Seaberg | 169/40 |
| 3,130,790 | 4/1964 | Hodgman, Jr. | 169/40 |
| 3,387,662 | 6/1968 | Molgano, Jr. | 169/62 X |

*Primary Examiner*—Robert J. Spar
*Assistant Examiner*—Fred A. Silverberg
*Attorney, Agent, or Firm*—Reuben Wolk; Charles E. Bricker

[57] ABSTRACT

A fire extinguishing apparatus and method of extinguishing a fire employing same are provided for an engine compartment of an engine drive vehicle in which the vehicle has an engine and a cooling system therefor employing a cooling liquid under pressure and the fire extinguishing apparatus comprises a system operatively connected to the cooling system for employing the cooling liquid under pressure and automatically spraying the cooling liquid in the compartment in response to a fire therein.

18 Claims, 3 Drawing Figures

FIRE EXTINGUISHING SYSTEM UTILIZING THE ENGINE COOLING SYSTEM

BACKGROUND OF THE INVENTION

1. Field of the Invention

This invention relates to a fire extinguishing apparatus for an engine compartment of an engine driven vehicle and to a method of extinguishing a fire in such engine compartment employing such fire extinguishing apparatus.

2. Prior Art Statement

Engine driven vehicles such as automobiles, trucks, buses, boats, railroad locomotives, and the like, are often operated by combustion engines which employ combustible fuels. It is a common occurrence for a fire to break out in an engine compartment of such a vehicle due to various causes including, a small fuel leak, engine backfire and fire in the engine carburetor, overheating and fire in electrical cables of the associated electrical system, and the like.

However, regardless of the cause of a fire, it is very important that it be extinguished immediately so that combustible materials in the associated engine compartment will not propogate the fire and cause it to spread to fuel provided from broken or damaged fuel supply lines, hydraulic fluid, and the like. Typical combustion materials in such an engine compartment include polymeric hose, nonmetallic components, electrical cables, and the like.

In the event of a fire, the common usual practice is for the vehicle operator to stop the vehicle and in the event such vehicle is an automobile, raise the hood of the engine compartment and employ a hand-operated extinguisher, if available, to extinguish any fire present. This procedure takes valuable time during which the fire usually is spreading and increasing in intensity. Further, once the hood is raised, additional air gets to the fire and serves to feed same aggravating the overall situation.

While it might be proposed (as is done in some aircraft systems) to provide a fire extinguishing system employing a separate and independent pressurized fluid source to extinguish any fire in an engine compartment, such a system adds substantial weight and cost to an overall vehicle and such weight and cost might not be readily justified in a vehicle such as an automobile where the risk of such fire in the engine compartment is not very great.

SUMMARY

It is a feature of this invention to provide a fire extinguishing apparatus for an engine compartment of an engine driven vehicle which is of minimum weight and cost.

Another feature of this invention is to provide a fire extinguishing apparatus of the character mentioned which utilizes one or more systems normally associated with the engine itself as a part of the fire extinguishing apparatus.

Another feature of this invention is to provide a fire extinguishing apparatus for an engine compartment of an engine driven vehicle in which the vehicle has an engine and a cooling system for the engine employing a liquid under pressure and wherein the fire extinguishing apparatus comprises means operatively connected to the cooling system for employing the cooling liquid thereof under pressure and automatically spraying the cooling liquid in the compartment in response to a fire therein.

Another feature of this invention is to provide a fire extinguishing apparatus of the character mentioned in which the means operatively connected to the cooling system comprises conduit means connected thereto and receiving the cooling liquid under pressure therein and spray means in flow communication with the conduit means for spraying the cooling liquid into the engine compartment in response to a fire therein.

Another feature of this invention is to provide a fire extinguishing apparatus of the character mentioned which provides a spray of liquid in a wide angle fine spray for maximum coverage.

Another feature of this invention is to provide a fire extinguishing apparatus of the character mentioned which may utilize a fire extinguishing material together with engine cooling liquid for fire extinguishing purposes.

Another feature of this invention is to provide a fire extinguishing apparatus of the character mentioned in which the fire extinguishing material may be in the form of a fire extinguishing liquid normally disposed in the conduit means of the fire extinguishing apparatus.

Another feature of this invention is to provide an improved method of extinguishing a fire in an engine compartment of an engine driven vehicle.

Another feature of this invention is to provide a method of the character mentioned in which the vehicle has an engine and a cooling system therefor which employs a cooling liquid under pressure and the method comprises operatively connecting a fire extinguishing apparatus to the cooling system for employing the cooling liquid under pressure to automatically spray the cooling liquid in the compartment in response to a fire therein.

Therefore, it is an object of this invention to provide an improved fire extinguishing apparatus and method of extinguishing a fire employing such apparatus having one or more of the novel features set forth above or hereinafter shown or described.

Other details, features, uses, objects, and advantages of this invention will become apparent from the embodiments thereof presented in the following specification, claims, and drawing.

BRIEF DESCRIPTION OF THE DRAWING

The accompanying drawing shows present preferred embodiments of this invention, in which.

DETAILED DESCRIPTION OF ILLUSTRATED EMBODIMENTS

Figure 1:
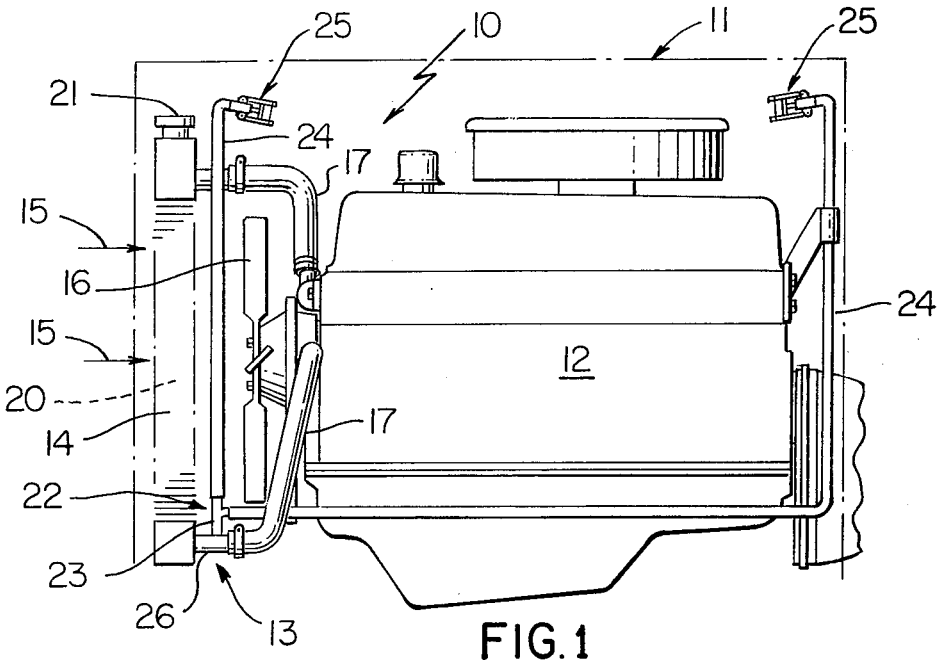
FIG. 1 is a side elevation of an engine compartment showing an engine and a cooling system therefor, and illustrating one exemplary embodiment of the apparatus and method of this invention.

Reference is now made to FIG. 1 of the drawing which illustrates one exemplary embodiment of a fire extinguishing apparatus and method of this invention which is designated generally by the reference numeral 10. The apparatus and method 10 are useable in an engine compartment which is designated generally by the reference numeral 11 of a motor driven vehicle (not shown) and such vehicle may be any type of vehicle operating on land or water such as an automobile, truck, bus, railroad locomotive, engine driven boat, or the like.

Typically the engine compartment has the usual engine 12 which may be powered by combustible fuel such as gasoline, alcohol, diesel oil, and the like; and, the engine 12 has a liquid cooling system of any suitable type known in the art and such cooling system is designated generally by the reference numeral 13.

The cooling system 13 has the usual radiator 14 which is in the form of a liquid-to-air heat exchanger and the radiator operates, as is known in the art, by cooling air indicated by arrows 15 flowing therethrough either due to ram air being forced through the radiator during movement of the vehicle which has the engine compartment 11 and/or due to air 15 being drawn through the radiator 14 by a mechanical fan 16 provided at the front end of the engine 12. The cooling system also has a plurality of hose each designated by the same reference numeral 17 interconnecting the radiator 14 with the engine 12; and, such cooling system employs a cooling liquid which is designated generally by the reference numeral 20. The cooling liquid 20 is a pressurized liquid which is suitably pressurized by pressurizing means such as a pressurizing valve 21 which is provided on the radiator 14.

In accordance with the teachings of this invention, the apparatus 10 comprises means operatively connected to the cooling system 13 for employing the cooling liquid 20 under pressure and automatically spraying such liquid in the compartment 11 in response to a fire therein as will now be described in detail. The means operatively connected to the cooling system comprises conduit means, designated generally by the reference numeral 22, and such conduit means receives cooling liquid 20 under pressure therewithin and spray means in flow communication with the conduit means for spraying the cooling liquid into the engine compartment 11 in response to a fire therein.

The conduit means 22 comprises a connector such as a T-shaped connector 23 which for convenience and ease of installation is shown installed in flow communication with a tubular hose fitting 26 at the lower portion of the radiator 14. The conduit means 22 also comprises a plurality of two conduits, each designated by the same reference numeral 24, and in this example each conduit 24 is connected in flow communication with the T-shaped connector 23. The apparatus 10 also comprises the previously mentioned spray means consisting of a plurality of spray head assemblies 25 corresponding in number to the number of conduits 24 and each head assembly 25 is connected in flow communication with an associated conduit 24 so as to receive cooling liquid 20 under pressure therewithin.

The cooling liquid 20 is pressurized utilizing the pressurizing valve 21; and, the magnitude of pressurization is the usual amount employed in comparatively newer model automobiles and is generally of the order of 12 to 16 pounds per square inch. Accordingly, the hose 17 comprising the cooling system 13, the conduits 24 of the fire extinguishing apparatus 10, and the head assemblies 25 are constructed to contain and convey liquid safely at the pressures indicated.

The conduits 24 are preferably made of lightweight materials capable of withstanding pressures as indicated whereby such conduits may be made of synthetic plastic materials such as nylon, or metallic materials such as aluminous materials.

Figure 2:
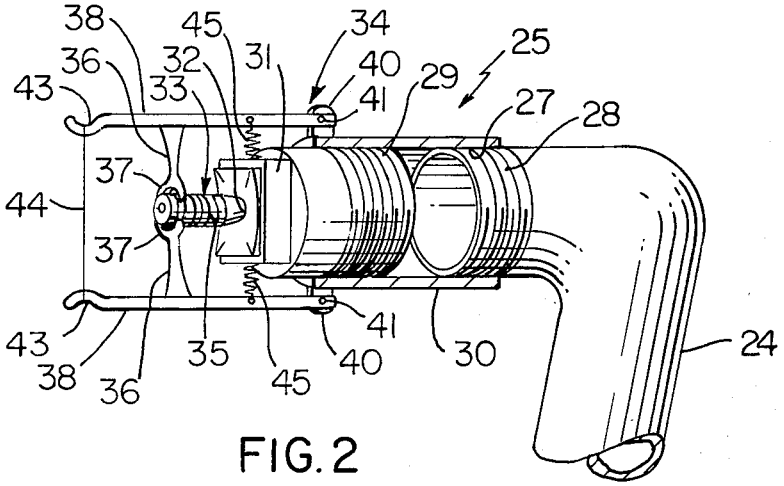
FIG. 2 is an enlarged view with parts in cross section, parts in elevation, and parts broken away illustrating details of a typical head assembly comprising the apparatus and method of this invention.

As seen in FIG. 2, each spray head assembly 25 is suitably detachably connected in flow communication with its associated conduit 24 and in a non-leaking manner; and, in this example each assembly has internal threads 27 therein and is threadedly fastened with external threads 28 provided in the end of its associated conduit 24. Each head assembly 25 comprises a tubular housing structure 30 which has a spray nozzle 31 suitably fastened therein in fluid-tight relation and in this example the nozzle 31 has external threads 29 which are suitably threaded within the internal threads 27 of the housing structure 30.

The nozzle 31 has a discharge orifice 32 which is particularly adapted to discharge cooling liquid in a wide angle pattern and in a fine spray such that generally of the order of 4 quarts of cooling liquid may be sprayed for a sufficient time period to provide a substantial extinguishing action of a fire in the engine compartment 11. The head assembly 25 also has a closure plug 33 for closing the orifice 32 and a mechanism which is designated generally by the reference numeral 34 for supporting the plug 33 in position in the orifice 32 during normal conditions and moving away from such plug substantially instantaneously in the event of a fire in the engine compartment 11.

The plug 33 is a bullet-like plug and has a plurality of annular serrations 35 provided therein and such serrations are particularly adapted to be engaged by a pair of plug holders, each designated by the reference numeral 36, of the mechanism 34. Each plug holder 36 has a yoke-like end member or end 37 and each holder 36 is suitably fixed to a pivoted arm 38 of the mechanism 34 and the plug holders engage the plug 33 at diametrically opposite positions thereon. Further, each arm 38 is pivotally supported on an integral ear or lug 40 of the housing structure 30. A pivot pin 41 is provided for each associated arm end and pivotally supports the same on the housing structure. A plurality of cooperating aligned openings in each arm 38 and its lug 40 receive a pin 41 therethrough enabling the pin to provide its supporting and pivoting function.

Each arm 38 has a recess 43 in its terminal outer end which is particularly adapted to receive a triggering filament 44, or the like, therearound to hold the arms 38 and the plug holders 36 with their yoke-like terminal ends 37 engaging the plug 33 on opposite sides of associated serrations 35 and as shown in FIG. 2. The mechanism 34 also has spring means shown in this example as a pair of oppositely arranged compression springs 45 each of which acts between an associated arm 38 and the housing structure 30 so as to yieldingly urge the associated arm 38 away from the housing structure. Accordingly, the springs 45 serve to urge the arms 38 away from each other.

Under normal operating conditions, the filament 44 holds the arms 38 together against the action of the springs 45 and the yoke-like ends 37 of the plug holders 36 engage serrations 35 of the plug 33 to hold such plug 33 in position and prevent escape of cooling liquid out of the orifice 32. However, in the event of fire in the engine compartment 11, the filament 44 is responsive to such fire causing breaking thereof. The breaking of filament 44 may be due to the action of flame impinging thereon or due to weakening thereof because of excessive temperature in the engine compartment. In this latter instance the physical properties of the filament 44 are such that it can easily withstand temperatures normally encountered in the engine compartment 11 but will break once such temperatures are exceeded substantially and such substantial temperatures would only occur with a fire in the engine compartment.

Once the filament 44 breaks, the arms 38 are substantially instantaneously propelled or moved outwardly by the compression springs 45 thereby pulling the plug holders 36 and their yoke-like ends 37 away from the plug 33. Once this occurs the liquid under pressure upstream of the orifice 32 expels or forces the plug 33 out of the orifice and such liquid is then substantially instantaneously forced through such orifice in a wide spray pattern so as to impinge upon any fire in the engine compartment 11 and provide an extinguishing action.

The filament 44 may be in the form of an endless band of small cross section which is simply slipped over the ends of the arms 38 into the recesses 43. Once the filament 44 is weakened or severed by fire or an excessive predetermined temperature, it is simply pulled apart by the action of the springs 45 allowing the cooling liquid 20 to be sprayed into the engine compartment. The filament 44 may also be a single rectilinear filament having a loop-like portion at each end thereof which is merely slipped over the end of an associated arm 38 into a recess 43. The filament 44 may be made of any suitable material known in the art and preferably such filament may be made of a synthetic plastic material such as nylon which is capable of withstanding substantial temperatures of the magnitude likely to be encountered in an engine compartment; however, once a predetermined high temperature is reached or such filament is impinged directly by a flame, the filament breaks or is easily pulled apart by the springs 45 allowing operation of the fire extinguishing apparatus.

Figure 3:
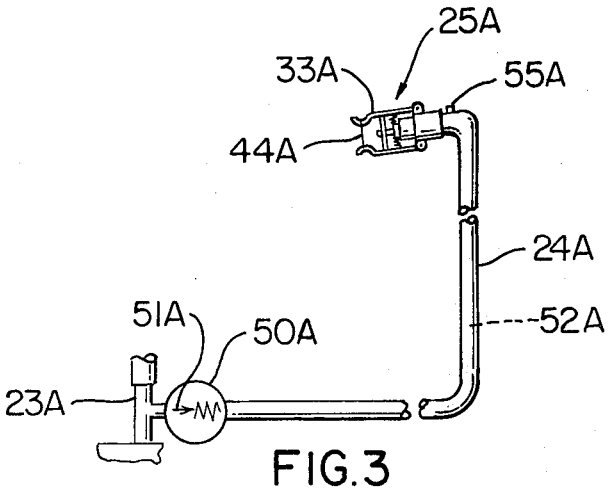
FIG. 3 is a view illustrating an apparatus and method wherein the typical head assembly of FIG. 2 may be used with a check valve and fire extinguishing fluid in an associated conduit.

A modification of the apparatus and method of this invention is shown in FIG. 3 of the drawing where a fragmentary portion of a conduit and associated head assembly are illustrated. The conduit and head assembly illustrated in FIG. 3 are very similar to the conduit and head assembly of FIG. 2; therefore, such conduit will be designated by the reference numeral 24A and the head assembly by the reference numeral 25A and component and associated parts of each which are similar to similar parts previously described in connection with FIG. 2 of the drawing will be designated by the same reference numeral as previously, whether or not such parts are mentioned in the specification, followed by the letter designation A and not described again in detail. Only those parts which are different from corresponding previously described parts will be designated by a new reference numeral also followed by the letter designation A and described in detail.

The conduit 24A has a check valve 50A suitably installed therein preferably at a location with the tee connector 23A adjoining its inlet. The check valve 50A allows engine cooling liquid to flow outwardly therethrough as indicated by the flow arrow 51A in such check valve. The check valve 50A allows a suitable fire extinguishing material; which in this example is shown as a fire extinguishing liquid 52A, to be used with the engine cooling liquid to provide a fire extinguishing action. The volume of the liquid 52A is determined by the volume of the conduit 24A from the check valve 50A to the head assembly 25A at the discharge end of the conduit 24A.

The conduit 24A with its check valve 50A and head assembly 25A may be used in the apparatus 10 substantially interchangeably with a conduit 24 and its head assembly 25; and, the operation is substantially the same except for the fact the initial flow of liquid is fire extinguishing liquid 52A followed by flow of engine cooling liquid.

The check valve 50A is preferably of a type which requires a certain predetermined minimum pressure generally of the order of 5 psig to open same and thereby allow flow of engine cooling liquid therethrough. The check valve may be loaded or controlled in any desired manner and in this example of the invention, the check valve is shown as being held spring-loaded closed by a compression spring which is shown schematically within the outline of the valve 50A. With the spring-loaded check valve 50A in the system, once the pressure in the engine cooling system reaches a value beneath the valve setting (5 psig, for example) the check valve 50A closes thereby preventing further discharge of engine cooling liquid into the engine compartment. Once the liquid remaining in the cooling system is confined, the vehicle using the fire extinguishing apparatus may be operated to a safe location. For example, if such a vehicle is an automobile it may be driven a short distance to a comparatively safe roadside location with minimum risk of engine damage due to inadequate engine cooling.

In some application of this invention it may also be preferred to provide means for increasing the speed with which the fire extinguishing liquid 52A is expelled into the engine compartment once the triggering filament 44A is broken. Toward this end suitable means may be provided for pressurizing the conduit 24A and such means may be in the form of a simple air pressurizing valve 55A. The valve 55A may be a so-called tire valve of the type well known in the tire industry. The pressure in the conduit 24A between the check valve 50A and the head assembly 25A may be of any suitable magnitude; however, with the utilization of a cooling system which employs a pressure generally of the order of 12 to 16 psig, the pressure in conduit 24A may be of the order of 20 psig. The 20 psig pressure in the conduit 24A is also effective in providing substantially instantaneous expulsion of the plug 33A once the triggering filament 44A is broken.

A spring-loaded check valve similar to check valve 50A may also be provided in the fire extinguishing apparatus 10 at any suitable position upstream of each associated head assembly 25 and for the purpose of closing off the cooling system 13 to prevent further expulsion of cooling liquid therefrom once the presure drops beneath 5 psig and for the same reason previously described. In addition, a pressurizing valve similar to the tire valve 55A may also be provided for pressurizing the conduit 24 with air and without using additional fire extinguishing material or liquid in such conduit. In this instance the air pressurized conduit 24 also provides instantaneous expulsion of the plug 33 once its filament 44 is broken.

The cooling liquid employed in the cooling system is the usual liquid employed for this purpose. In the case of an automobile, such cooling liquid is preferably a mixture of water and ethylene glycol.

The fire extinguishing material 52A described in connection with FIG. 3 is in the form of fire extinguishing liquid 52A; however, it will be appreciated that any suitable fire extinguishing material may be used and may be any suitable liquid, gas, powder, or the like.

Reference has been made herein to the utilization of a nozzle 31 or 31A which sprays fluid in a wide angle pattern and one example of a nozzle which may be used is made by Spraying Systems Co., North Avenue at Schmale Road, Wheaton, Ill. 60187 and sold under the registered trademark Fulljet Nozzle. Such a nozzle utilized in a ⅜" pipe and with a pressure of 10 psig sprays 2 gallons per minute of liquid; and, the nozzle provides coverage 12 inches from the nozzle dishcarge over a 28 inch square (784 square inches) in a wide angle square spray pattern having a included angle between opposite sides of the square pattern generally of the order of 110 degrees.

Reference was also made to the utilization of a spring loaded check valve 50A and a valve which may be used and opens at 5 psig is also made by the above-mentioned Spraying Systems Co. of the above address and sold under the No. 4193A.

In this disclosure of the invention a plurality of only two conduits, each with an associated head assembly at its outer end, have been used in the illustrated engine compartment and comprise the fire extinguishing system. However, it is to be understood that more than two conduits and associated head assemblies may be used as desired.

While present exemplary embodiments of this invention, and methods of practicing the same, have been illustrated and described, it will be recognized that this invention may be otherwise variously embodied and practiced within the scope of the following claims.

What is claimed is:

1. In a fire extinguishing apparatus for an engine compartment of an engine driven vehicle in which said vehicle has an engine and a cooling system for said engine employing a cooling liquid under pressure, the improvement wherein said fire extinguishing apparatus comprises means operatively connected to said cooling system for employing said cooling liquid under pressure and automatically spraying said cooling liquid in said compartment in response to a fire therein, said means operatively connected to said engine cooling system comprises separate conduit means connected to said cooling system and receiving said cooling liquid under pressure therewithin, and separate spray means in flow communication with said conduit means for spraying said cooling liquid into said engine compartment in response to said fire.

2. A fire extinguishing apparatus as set forth in claim 1 in which said conduit means comprises a plurality of conduits and said spray means comprises a corresponding plurality of spray head assemblies each connected in flow communication with an associated conduit.

3. A fire extinguishing apparatus as set forth in claim 2 in which each of said conduits is a high strength lightweight conduit.

4. A fire extinguishing apparatus as set forth in claim 2 in which each head assembly comprises a spray nozzle having a discharge orifice for providing a spray of said cooling liquid, a closure plug for closing said orifice, and a mechanism for supporting said plug in said orifice during normal conditions and moving away from said plug substantially instantaneously in the event of said fire allowing pressure of said cooling liquid acting against said plug to eject same from said discharge orifice.

5. A fire extinguishing apparatus as set forth in claim 4 in which said mechanism comprises a pair of arms pivotally supported on opposite sides of said head assembly, a plug holder on each of said arms engaging opposite sides of said plug during said normal conditions, spring means normally yieldingly urging said arms away from each other, and a fire responsive filament normally holding said arms together with said plug holders engaging opposite sides of said plug.

6. A fire extinguishing apparatus as set forth in claim 5 in which each of said head assemblies comprises, a housing structure, a pair of lugs extending from diametrically opposite positions on said housing structure, and a pivot pin for each lug and an associated arm end and pivotally supporting same on said housing structure, said spring means consisting of a pair of compression springs each acting between said housing structure and an associated arm.

7. A fire extinguishing apparatus as set forth in claim 4 and further comprising a one-way check valve in each conduit upstream of its head assembly and allowing flow of cooling liquid out of said cooling system.

8. A fire extinguishing apparatus as set forth in claim 7 in which each of said check valves is spring loaded having a predetermined opening pressure generally of the order of ⅓ of the operating pressure of said liquid in said cooling system.

9. A fire extinguishing apparatus as set forth in claim 8 in which each check valve is disposed upstream of its head assembly with a predetermined length of conduit therebetween and further comprising a fire extinguishing material disposed in each predetermined length of conduit, said fire extinguishing material being expelled with said cooling liquid and cooperating therewith to help extinguish said fire.

10. A fire extinguishing apparatus as set forth in claim 9 and further comprising a plurality of air pressurizing valves each extending through an associated one of each of said predetermined lengths of conduit for pressurizing its conduit length and fire extinguishing material disposed therein to a pressure greater than the pressure of said cooling liquid, said greater pressure providing a more rapid expulsion of its associated plug and fire extinguishing material in the event of said fire.

11. A fire extinguishing apparatus as set forth in claim 10 in which said fire extinguishing material in each of said predetermined lengths of conduit is a fire extinguishing liquid.

12. In a method of extinguishing a fire in an engine compartment of an engine driven vehicle in which said vehicle has an engine and a cooling system for said engine employing a cooling liquid under pressure, the improvement in said method comprising the steps of operatively connecting a separate fire extinguishing apparatus to said cooling system for employing said cooling liquid under pressure and automatically spraying said cooling liquid from said apparatus into said compartment in response to a fire therein, said operatively connecting step comprises the steps of connecting separate conduit means to said cooling system and receiving said cooling liquid under pressure therewithin, and fastening separate spray means in flow communication with said conduit means for spraying said cooling liquid into said engine compartment in response to said fire.

13. A method as set forth in claim 12 in which said step of connecting conduit means comprises connecting a plurality of conduits to said cooling system and said step of fastening said spray means comprises fastening a corresponding plurality of spray head assemblies each in flow communication with an associated conduit.

14. A method as set forth in claim 13 in which said step of fastening said plurality of head assemblies comprises providing said head assemblies each having a discharge orifice for providing a spray of said cooling liquid, a closure plug for closing said orifice, and a mechanism for supporting said plug in said orifice during normal conditions and moving away from said plug substantially instantaneously in the event of said fire allowing pressure of said cooling liquid acting against said plug to eject same away from said discharge orifice.

15. A method as set forth in claim 14 and comprising the further step of installing a one-way check valve in each conduit upstream of its head assembly which allows flow of cooling liquid out of said cooling system.

16. A method as set forth in claim 15 in which said installing step comprises installing each of said one-way check valves having a predetermined opening pressure generally of the order of 5 psig.

17. A method as set forth in claim 16 and comprising the further step of pressurizing each conduit between its check valve and head assembly to a pressure greater than the pressure of said cooling liquid, said greater pressure providing a more rapid expulsion of its associated plug in the event of said fire.

18. A method as set forth in claim 17 and comprising the further step of disposing a fire extinguishing material in each conduit between its check valve and head assembly, said fire extinguishing material being expelled with said cooling liquid and cooperating therewith to help extinguish said fire.

* * * * *